United States Patent [19]

Wingert

[11] 4,008,584

[45] Feb. 22, 1977

[54] DRAW BOLT

[75] Inventor: Rudolf Wingert, High Crest Lake, N.J.

[73] Assignee: Presto Lock Company, Division of Walter Kidde & Company, Inc., Elmwood Park, N.J.

[22] Filed: Jan. 7, 1975

[21] Appl. No.: 539,076

[52] U.S. Cl. ..... 70/73; 292/113; 292/DIG. 49; 292/247

[51] Int. Cl.[2] ..... E05B 65/48

[58] Field of Search ..... 70/69, 70, 71, 72, 73, 70/74, 75, 76; 292/97, 113, 114, 123, 126, 247, 248, 249, 250, DIG. 31, DIG. 49

[56] References Cited

UNITED STATES PATENTS

| | | | |
|---|---|---|---|
| 2,784,994 | 3/1957 | Hopkins | 292/247 |
| 2,798,371 | 7/1957 | Gehrie | 70/73 |
| 2,829,912 | 4/1958 | Kock | 292/114 |
| 2,859,996 | 11/1958 | Atkinson | 292/114 |
| 3,169,788 | 2/1965 | Slan | 292/177 |
| 3,584,906 | 6/1971 | Budzyn | 292/247 |

*Primary Examiner*—Robert L. Wolfe
*Attorney, Agent, or Firm*—Shapiro and Shapiro

[57] ABSTRACT

An improved draw bolt of the type including a frame, link means having one end pivotally connected to the frame, and a manually operable latch member pivotally connected to the other end of the link means for movement with the link means to latching and unlatching positions. A leaf spring secured to the frame is cooperable with the link means for moving the hasp-engaging end of the latch member completely clear of the hasp upon release of the manual force applied to lift the other end of the latch member away from the frame. In the preferred draw bolt, the link means comprises a spaced pair of link members and a key-actuatable bolt member is carried by the latch member between the two link members, the bolt member being engageable with a stud on the frame for releasably locking the latch member in the latching position.

11 Claims, 10 Drawing Figures

DRAW BOLT

BACKGROUND OF THE INVENTION

Draw bolts of the type including a frame, a link member having one end pivotally connected to the frame and a manually operable latch member pivotally connected to the other of the link member for movement to latching and unlatching positions are well known in the art. See, for example, U.S. Pat. No. 2,784,994 to Hopkins and No. 3,526,422 to Trotter. Draw bolts of this general type which also employ springs for causing the latch member to move completely clear of the hasp when the latch member is released are disclosed by U.S. Pat. No. 2,798,371 to Gehrie and No. 2,829,912 to Koch. The Gehrie draw bolt is further provided with a key-actuatable bolt member which is carried by the latch member and engageable with the link member for releasably locking the latch member in latching position.

Although draw bolts of this type have been suitable for use on luggage cases and other hinged containers having cooperable sections to be releasably locked together, the construction of such draw bolts has required that they be mounted with their longitudinal axes perpendicular to the parting line of the cooperable sections of the case or container. Thus, with respect to luggage cases, such draw bolts do not provide the pleasing aesthetic appearance of other types of latching devices which can be mounted with their longitudinal axes parallel to the parting line of the case. Moreover, the length of such draw bolts may make it impractical to mount the draw bolt and the associated hasp on the cooperable valance members of the case.

SUMMARY OF THE INVENTION

It is an object of the invention to provide an improved draw bolt of the above-described general type for luggage cases and the like, and more particularly to provide a draw bolt for mounting on a luggage case with its longitudinal axis parallel to the parting line of the case.

Another object of the invention is to provide a draw bolt of improved and simplified construction which enables the latch member to effect complete release of the hasp upon release of the manual force applied to lift the latch member away from the frame.

Still another object of the invention is to provide an improved draw bolt of the above-described type having key-actuatable means for releasably locking the draw bolt in the latching position.

The draw bolt constructed in accordance with the invention comprises a frame, link means having one end pivotally connected to the frame, a manually operable latch member pivotally connected to the other end of the link means for movement to latching and unlatching positions, and a leaf spring mounted on the frame and engageable with the link means for moving the latch member completely clear of the hasp when the manual lifting force applied to the latch member is released. The link means has lowered and raised positions, respectively, for the latching and unlatching positions of the latch member, the lach member providing a hasp-engaging lug at one end thereof and a projection for manual engagement at the opposite end thereof. When the latch member has been manually lifted upwardly from the frame to the extent necessary to move the hasp-engaging lug outwardly out of engagement with the hasp, limiting means provided by the latch member and the link means cooperate with the hasp for limiting pivotal movement of the link means in a first direction from the lowered position to another position beyond the raised position, thereby limiting movement of the latch member upwardly from the frame. Upon release of the lifting force applied to the latch member, the leaf spring pivots the link means in a direction opposite to the direction of lifting to reach the raised position, the leaf spring resiliently opposing pivotal movement of the link means in both directions from the raised position of the link means. The latch member and the link means have cooperable means for resiliently opposing relative pivotal movement therebetween. Thus, the latch member is pivoted with the link means as the link means is moved into the raised position by the leaf spring, thereby causing the hasp-engaging lug of the latch member to be moved upwardly to completely clear the hasp.

In the preferred form of the draw bolt, the link means comprises two longitudinally spaced link members. A key-actuatable bolt member is carried by the latch member between the two link members and is engageable with a stud on the frame for releasably locking the latch member in the latching position.

The above-described objects and advantages of the invention, as well as other advantages and improved results, will be apparent from the following detailed description of the invention.

DESCRIPTION OF THE PREFERRED EMBODIMENT

Figure 1:
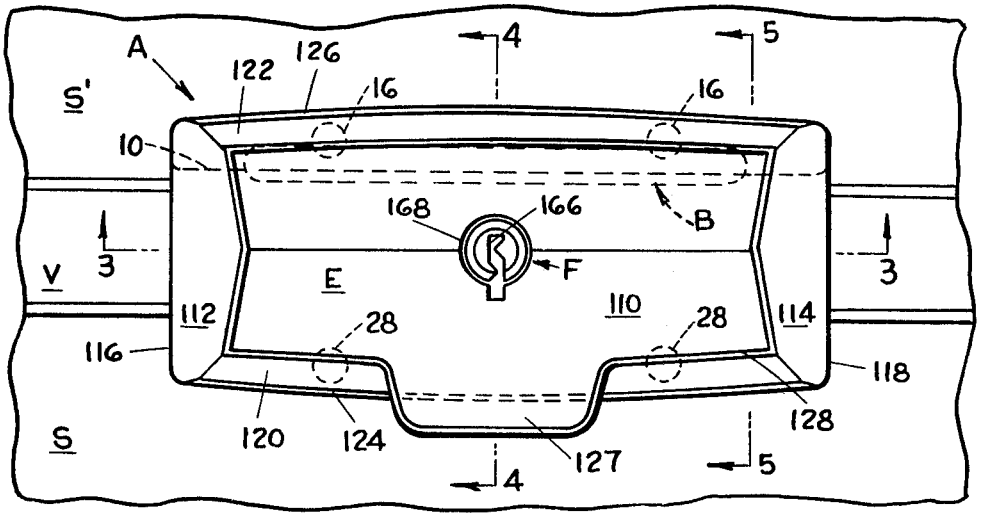
FIG. 1 is a top plan view of a draw bolt made in accordance with the invention mounted on one of the cooperable sections of a luggage case, this view showing the latch member in latching engagement with a cooperable hasp connected to the other luggage case section.

Referring to the drawings, a lockable draw bolt A constructed in accordance with the invention for cooperation with a hasp B is shown mounted on a luggage case. However, as will be apparent from the following description, the draw bolt of the invention may be employed to releasably lock together the cooperable sections of any suitable hinged case or container.

Figure 6:
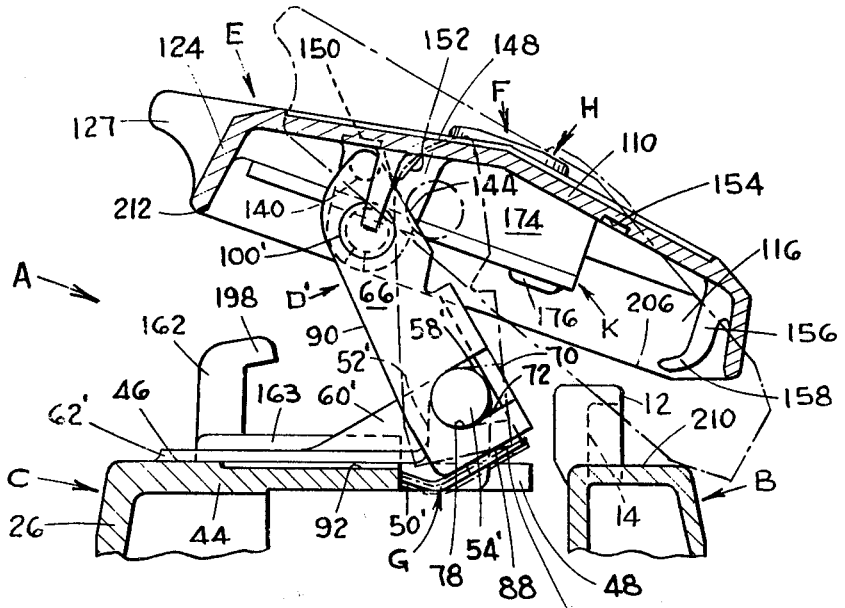
FIG. 6 is a view similar to FIG. 5, but showing the latch member and link members in the unlatching position (solid lines) and in the limit position (in phantom)

Referring to FIG. 1, draw bolt A is constructed so that when mounted or connected to a luggage case section, its longitudinal axis will be parallel to the parting line of the luggage case. As shown in FIG. 6, the draw bolt essentially comprises a mounting plate or frame C, link means in the form of a pair of link members D and D' (see FIGS. 2 and 3) each having one end thereof pivotally connected to the mounting plate, and a latch member E pivotally connected to the other ends of the link members for movement with the link members between latching and unlatching positions. A key-actuatable locking mechanism F is carried by the latch member between the link members for releasably locking the latch member in latching position. For convenience of manufacture, it is preferred that the hasp, frame and latch member be made by die casting these parts.

Figure 10:
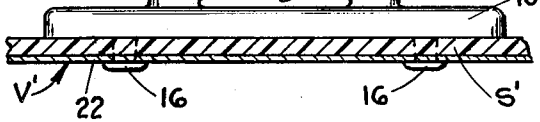
FIG. 10 is a side elevational view of the hasp.
Figure 4:
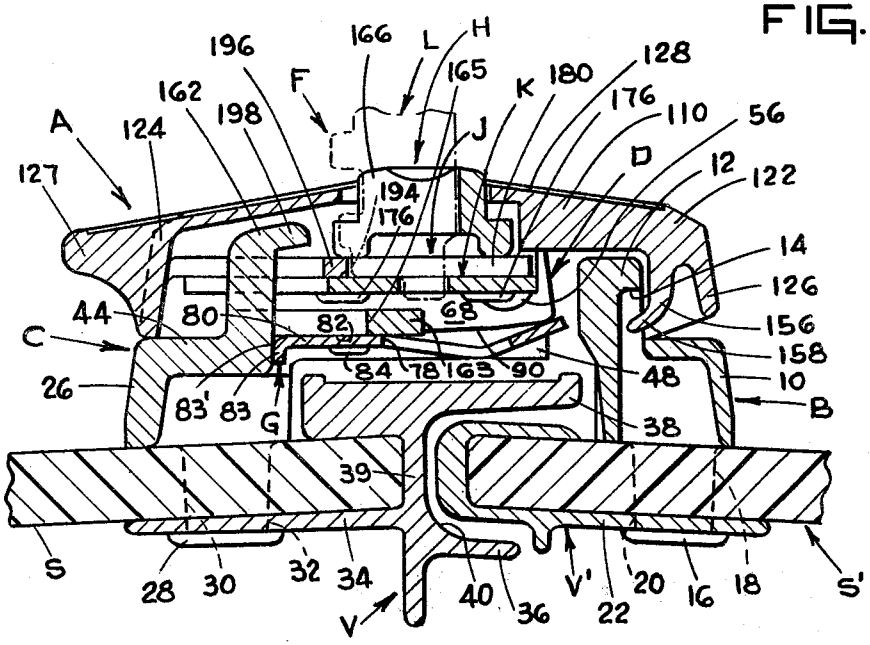
FIG. 4 is an enlarged, transverse cross-sectional view taken approximately in the plane of line 4—4 of FIG. 1.

In greater detail, and referring to FIGS. 4 and 10, hasp B includes a narrow longitudinal base portion 10 having a projection 12 upstanding centrally therefrom, the central portion of the projection being cut away at a side thereof to provide a recess 14 engageable by the latch member. The hasp may be mounted on wall S' of one of the cooperable luggage case sections by any suitable means. For example, and as illustrated, the base portion 10 of the hasp may be provided with a pair of longitudinally spaced, connecting studs 16. Referring to FIG. 4, these studs extend through respective openings 18 in wall S' and through aligned openings 20 in the bottom flange 22 of a valance member V' which is suitably mounted at the edge of wall S', the ends of the connecting studs being headed over to secure the hasp to the wall and to the valance member.

Mounting plate or frame C may be mounted to wall S of the other cooperable luggage case section in similar fashion. Specifically, and as shown in FIG. 1, base portion 26 of the frame may be provided with a pair of longitudinally spaced, connecting studs 28 which extend through respective openings 30 (FIG. 4) in wall S and through aligned openings 32 in the bottom flange 34 of a valance member V which is suitably mounted to the edge of wall S, the ends of the connecting studs being headed over to secure the frame to the wall and valance member. In the illustrated embodiment, V and V' designate female and male valance members, respectively, of the case. As shown in FIG. 4, female valance member V is further provided with a bottom flange 36 and a top flange 38 which are parallel and which project outwardly from the edge of web 39 to define a recess 40 for receiving male valance member V' when the luggage case is closed. The valance members are known in the art and do not constitute part of the present invention.

Figure 3:
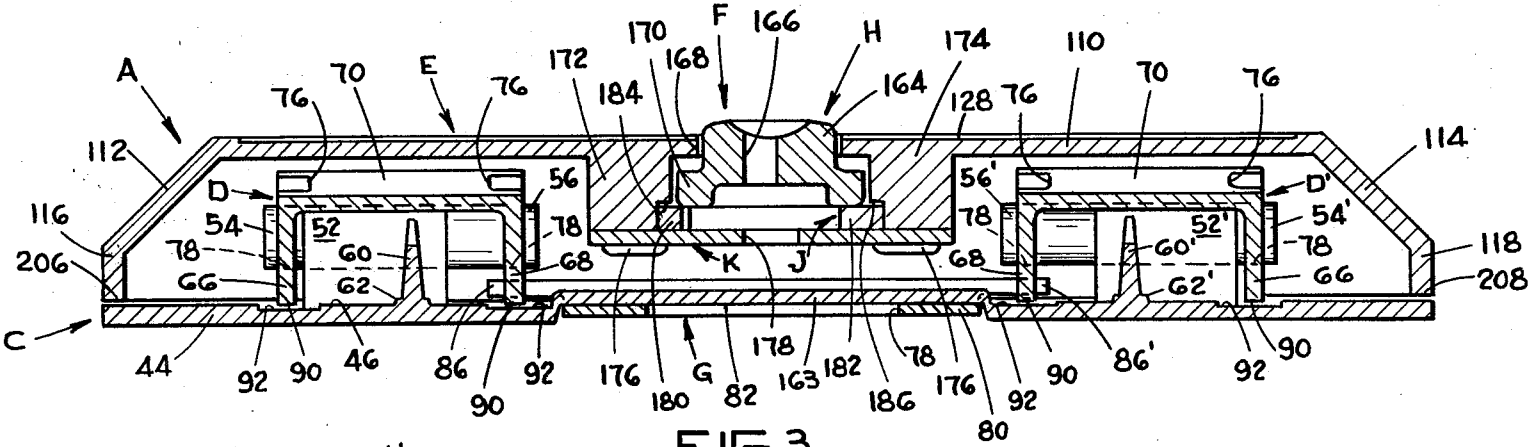
FIG. 3 is an enlarged, longitudinal cross-sectional view taken approximately in the plane of line 3—3 of FIG. 1.
Figure 8:
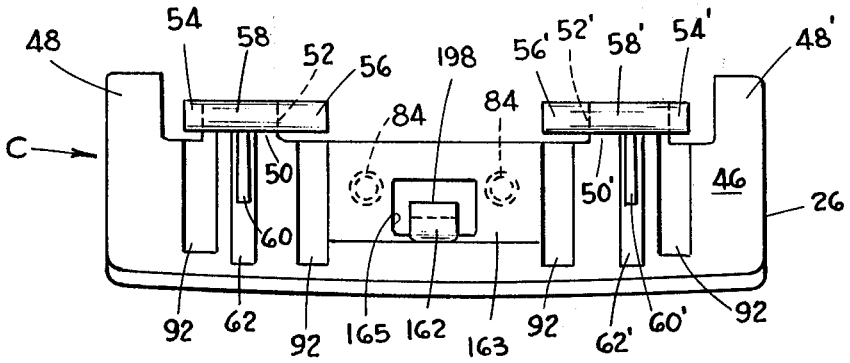
FIG. 8 is a top plan view of the frame component of the draw bolt.

Referring to FIG. 6, base portion 26 of the frame provides a top wall 44 having a planar top surface 46, the top wall being generally rectangular in shape and having a pair of transverse extensions 48 and 48' at opposite ends thereof, as shown in FIG. 8. Located intermediate these extensions are a pair of longitudinally spaced, shorter transverse extensions 50 and 50' which merge with and support thicker upstanding studs 52 and 52', respectively, (see FIG. 3) which are rectangular in horizontal cross section. Projecting longitudinally from opposite sides of the top portion of stud 52' are aligned, cylindrical trunnions 54' and 56' which cooperate with the cylindrical top surface 58' (FIG. 6) of the stud to provide a pivot pin formed integrally with the frame. The top portion of stud 52 is provided with similar trunnions 54 and 56 which are cooperable with cylindrical top surface 58 of stud 52 for forming a second pivot pin aligned with and longitudinally spaced from the first pivot pin. As shown in FIG. 8, the inwardly directed trunnions 56 and 56' are approximately twice as long as the outward trunnions 54 and 54'. Referring to FIGS. 3 and 8, narrow transverse walls 60 and 60', which are triangular in shape (FIG. 6), slope upwardly from the center of wider transverse ribs 62 and 62', respectively, of the frame to merge with and reinforce upstanding studs 52 and 52'.

Figure 2:
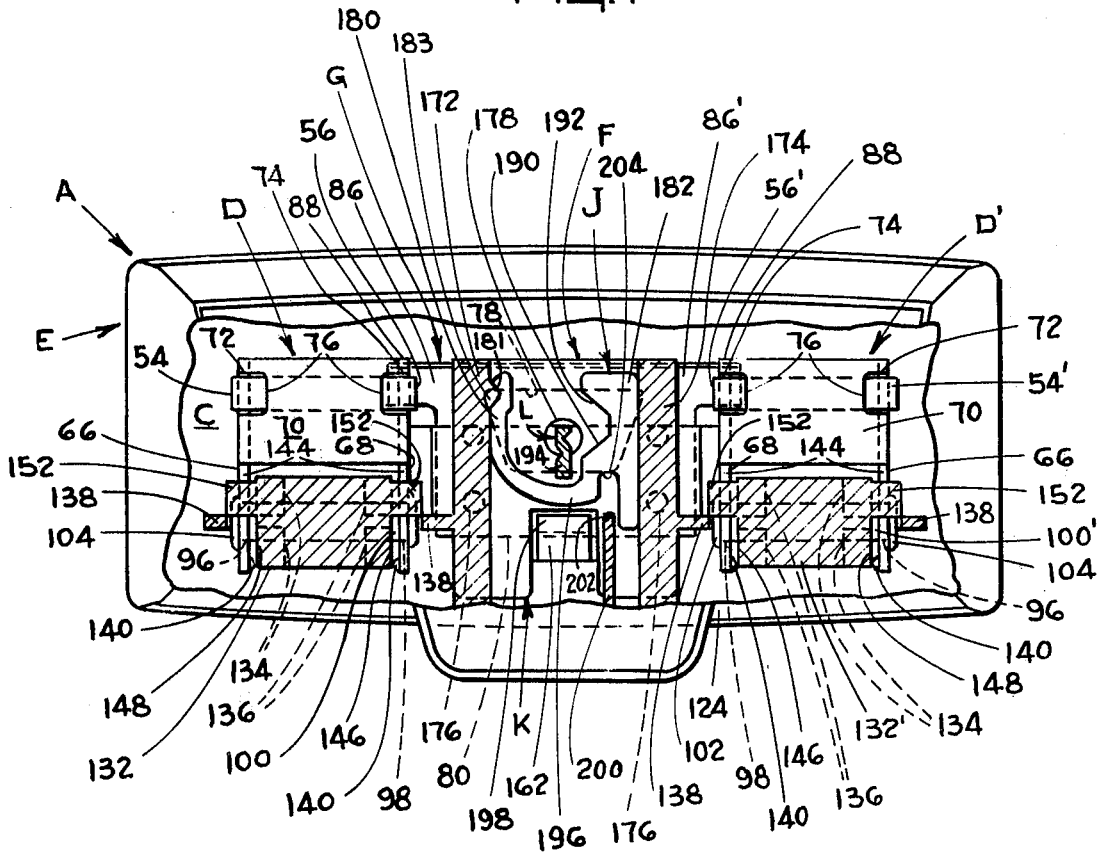
FIG. 2 is an enlarged, top plan view similar to FIG. 1, but with the latch member broken away and in cross section.

Referring to FIGS. 2 and 3, each of the pair of link members D and D' comprises a thin steel plate bent to provide a pair of spaced, parallel, transverse side walls 66 and 68 depending perpendicularly from opposite edges of a planar top wall 70. The transverse dimension of the top wall is approximately one-half the transverse dimension of the side walls, the top wall merging with each side wall adjacent one end of the side walls, as shown in FIG. 2. Referring to link member D' in FIG. 2, longitudinally aligned openings 72 (FIG. 6) and 74 are provided in side walls 66 and 68, respectively, for receiving trunnions 54' and 56', respectively, of the frame, these openings also extending a short distance along the top wall 70 as indicated at 76. Referring to FIG. 6, the semicircular bottom edges 78 of openings 72 and 74 in the link member side walls engage trunnions 54' and 56', respectively, and top wall 70 engages the cylindrical top surface 58' of upstanding stud 52' for pivotally connecting the link member D' to the mounting plate. Similar openings 72 and 74 in link member D receive trunnions 54 and 56, respectively, for pivotally connecting that link member to the frame.

Figure 5:
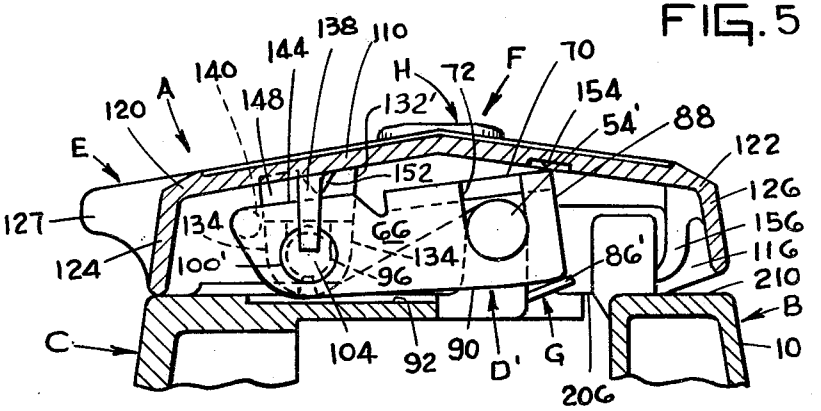
FIG. 5 is an enlarged, transverse cross-sectional view taken approximately in the plane of line 5—5 of FIG. 1; this view omitting the showing of the valance members and the luggage case sections.
Figure 9:
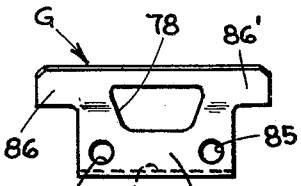
FIG. 9 is a top plan view of the leaf spring component of the draw bolt.

A generally T-shaped detent leaf spring G (FIG. 9) having an opening 78 therein has its narrow end portion 80 suitably secured to a recessed surface 82 (FIG. 4) in the underside of top wall 44 of the frame, with a narrow, downturned edge portion 83 at that end of the spring being adjacent vertical surface 83' of the frame. For example, and as illustrated, the leaf spring may be secured in such position by a pair of hollow connecting studs 84 (FIG. 8) which depend from recessed surface 82 and are extended through respective openings 85 (FIG. 9) in the leaf spring before being headed over, as shown in FIG. 4. The other end of the leaf spring, which provides a pair of oppositely projecting, longitudinally extending spring fingers 86 and 86' (FIG. 9), is inclined upwardly relative to end portion 80 of the leaf spring so as to bias the spring fingers into engagement with the edges of inner side walls 68 of the respective link members, as shown in FIGS. 2, 3, and 4. The spring fingers are cooperable with the planar end surfaces 88 of those side walls for resiliently maintaining the link members in the raised position shown in solid lines in FIG. 6 and are cooperable with the bottom surfaces 90 of those side walls for resiliently maintaining the link members in the lowered position shown in FIG. 5. Referring to FIG. 8, planar top surface 46 of the frame has four shallow, transverse recesses 92 therein to provide clearance for the bottom edges 90 of side walls 66 and 68 of the link members when they are in the lowered position, as shown in FIGS. 3 and 5. Referring to FIG. 2, the other ends of side walls 66 and 68 of the link members are provided with longitudinally aligned circular openings 96 and 98, respectively. Pivot pins 100 and 100' have their opposite ends received in these openings in link members D and D', respectively, each pivot pin having a head 102 at the inner end thereof and having the other end 104 headed over after insertion through the openings, as shown in FIGS. 2 and 5.

Referring to FIG. 5, the latch member E includes a top wall 110 having a transverse cross section generally in the shape of a flattened, inverted V. As shown in FIG. 3, depending from the opposite transverse edges of the top wall at approximately a 45° angle are transverse, sloping, downwardly diverging walls 112 and 114. The lower edges of these walls merge with transverse side walls 116 and 118, respectively, which are perpendicular to top wall 110. Depending from the opposite longitudinal edges of the top wall at approximately a 30° angle are narrow sloping walls 120 and 122 (FIG. 5) which merge with slightly diverging longitudinal side walls 124 and 126. Formed integrally with the central portions of longitudinal walls 120 and 124 at one end of the latch member is a projection 127 (FIG. 2) which projects outwardly from wall 124 for manual engagement. Referring to FIGS. 1, 3, and 4, the top surfaces of top wall 110 and projection 127 may have a shallow recess 128 formed therein. This recess may receive a decorative insert or the recessed surface thereof may be textured to provide a desired aesthetic effect. It will be understood that the latch member may have any suitable configuration consistent with the functional purposes of providing a member which may be connected to the link members D, D', to cover the frame member C and to provide a portion which may be manually engaged to raise and lower the latch member.

Figure 7:
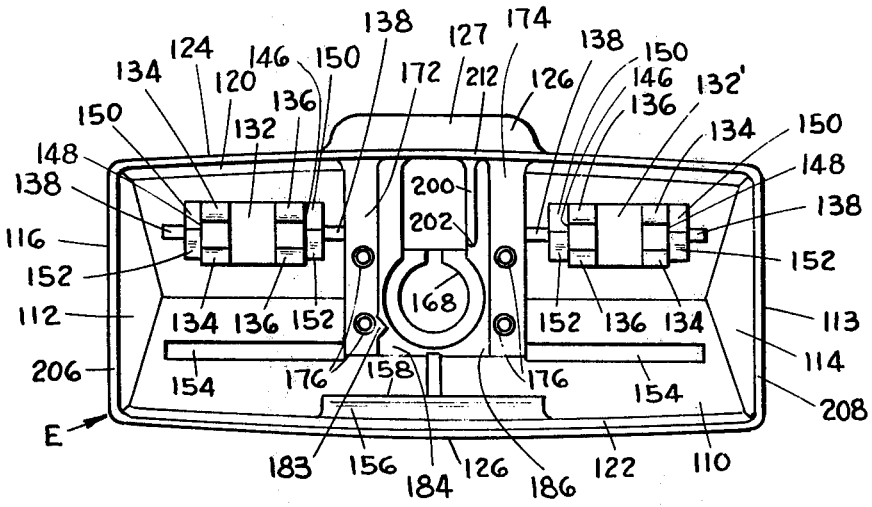
FIG. 7 is a bottom plan view of the latch member component of the draw bolt.

Depending from the top wall 110 of the latch member near side wall 124 are a pair of longitudinally spaced, longitudinally elongated, rectangular studs 132 and 132' (FIG. 7), each having its longitudinal dimension somewhat shorter than the distance between side walls 66 and 68 of the respective link members, as shown in FIG. 2. Depending from each of the studs adjacent the opposite transverse edges thereof are two pair of lugs 134 and 136 (FIG. 7), the distance between the lugs of each lug pair being slightly greater than the diameter of pivot pins 100 and 100'. Referring to FIG. 2, the portion of each pivot pin between the side walls of the associated link member is received between the lugs of each lug pair, the lugs being bent over the pivot pins, as shown in FIG. 5, to secure the pivot pins to the latch member, thereby pivotally connecting the corresponding ends of the link members to the latch member. As shown in FIG. 7, the latch member is further provided with four longitudinally spaced lugs 138 which project from the top wall 110 adjacent the ends of the pivot pins, as shown in FIGS. 2 and 5, for centering the link members relative to studs 132 and 132'.

Referring to FIG.2, the ends of link member side walls 66 and 68 which are pivotally connected to the latch member are provided with small inwardly-facing bumps or projections 140 near the top edges 144 of the side walls, as shown best in FIG. 5. These projections are adapted to frictionally engage adjacent transverse side surface 146 and 148 of studs 132 and 132' for resiliently opposing pivotal movement of the latch member relative to the link members for reasons which will be apparent hereinafter. Referring to FIG. 7, the underside of top wall 110 has four short, transverse recesses 150 therein to provide clearance for the ends of the link member side walls when the latch member and link members are in the relative positions shown in FIG. 6. Additionally, projections 152 depend from the top wall transversely adjacent recesses 150 and are cooperable with the top surfaces 144 of the link member side walls (see FIG. 6) for limiting clockwise rotation of the latch member relative to the link members to the position shown in solid lines in FIG. 6 with the device oriented as shown. The underside of the top wall is further provided with a pair of longitudinal recesses 154 (FIG. 7) to provide clearance for the longitudinal edges of link member top walls 70 which are adjacent end surfaces 88 of the link members for the lowered position of the link members, as shown in FIG. 5. Referring to FIGS. 4 and 7, formed integrally with the latch member is a centrally located, longitudinally extending lug 156 which projects substantially parallel to side wall 126 before turning inwardly approximately 45° to provide a lug portion 158 which is receivable by recess 14 in hasp B (FIG. 4).

Referring to FIG. 3, locking mechanism F, which is carried by the latch member between the two link members, comprises a rotatable key barrel H, a key-actuatable bolt member J, and a cover plate K, the bolt member being cooperable with an upstanding stud 162 (FIGS. 4, 6 and 8) provided by the frame. As shown in FIG. 6, the stud projects upwardly from a raised rectangular portion 163 of the frame, the raised portion having a U-shaped opening 165 therethrough (FIG. 8) adjacent the stud. Returning to FIG. 3, the narrow cylindrical portion 164 of key barrel H, which has an opening or keyhole 166 therethrough for receiving a key L (FIG. 4), projects through a circular opening 168 provided in the center of top wall 110 of the latch member between the link members. An outer, annular flange 170 at the bottom end of the key barrel rests upon bolt member J to rotatably support the key barrel in opening 168, the flange also being cooperable with top wall 110 to maintain the key barrel in the latch member. Bolt member J is supported for sliding movement beneath flange 170 of the key barrel by cover plate K, which is secured to the ends of a pair of longitudinally spaced, transverse walls 172 and 174 which depend from the top wall 110 of the latch member (FIG. 7). The cover plate may be mounted in such position by any suitable means, such as by hollow connecting studs 176 (FIGS. 3, 4 and 7) which project from the end surfaces of the walls through respective openings in the cover plate and then are headed over. The cover plate is provided with a circular opening 178 (FIGS. 2 and 3) for receiving the end of key L when it is inserted through the key barrel.

Bolt member J (FIG. 2), which is carried between studs 132 and 132' of the latch member for transverse movement between the link members, comprises a generally U-shaped, resilient member formed of a suitable material, such as aluminum. Referring to FIG. 3, the arms or legs 180 and 182 of the bolt member are supported for sliding movement between cover plate K and shoulders 184 and 186, respectively, which are formed in the latch member adjacent the facing sides of walls 172 and 174. It is preferred that the transverse width of the bolt member when in relaxed condition (i.e., when removed from the latching device) be slightly greater than the distance between the facing surfaces of walls 172 and 174 so that the legs of the bolt member are biased into engagement with those surfaces, thereby to resiliently oppose transverse movement of the bolt member. Referring to FIG. 2, leg 182 of the bolt member is provided with surfaces 190 and 192 which are engageable by a tooth 194 of key L for moving the bolt member transversely between the unlocking position shown in FIGS. 2 and 4 and a locking position (not shown). In the locking position, the end portion 196 of bolt member is engageable with a transversely extending lug 198 at the end of stud 162 on the frame for releasably locking the latch member in the lowered, latching position shown in FIG. 4. Leg 180 of the bolt member has a notch 181 (FIG. 2) formed in the side thereof for receiving a projection 183 on wall 172 of the latch member, thereby to resiliently maintain the bolt member in the unlocking position shown in FIG. 2. The end surface of leg 180 is cooperable with projection 183 to resiliently maintain the bolt member in the locking position. Referring to FIGS. 2 and 7, a thin transverse wall 200 depends from the top wall of the latch member near wall 174 and has an end surface 202 cooperable with a surface 204 of the bolt member (FIG. 2) for limiting movement of the bolt member outwardly from the latch member to the locking position.

Operation of the draw bolt of the invention will now be described. Referring to FIG. 5, which shows the latch member E in lowered, latching position in engagement with hasp B, in order to release the hasp manual lifting force is applied against the underside of projection 127 at one end of the latch member to lift that end away from frame C, causing the latch member to pivot about its opposite end relative to the frame. With the parts oriented as illustrated, link members D and D′ during this motion of the latch member are caused to pivot clockwise about the axis provided by trunnions 54, 54′, 56, and 56′ of the frame. However, because the bottom edges 206 and 208 (FIGS. 3 and 7) of the transverse side walls 116 and 118 of the latch member rest upon the top surface 210 (FIG. 5) of base portion 10 of the hasp, the latch member is not able to move clockwise together with the link members, but instead is caused to pivot counterclockwise relative to the link members as the latch member is tilted upwardly away from the frame. This counterclockwise pivotal movement of the latch member relative to the link members is resiliently opposed by the interaction of projections 140 on link member side walls 66 and 68 with transverse surfaces 146 and 148 of studs 132 and 132′ of the latch member (FIG. 2), thereby causing bottom edges 206 and 208 at the hasp-engaging end of the latch member to be maintained in contact with surface 210 of the hasp. These bottom edges therefore slide across surface 210 of the hasp as the other end of the latch member is lifted away from the frame, thereby imparting both pivotal and translational movement to the latch member so that the hasp-engaging lug portion 158 moves outwardly transversely from the frame to disengage the hasp. With bottom edges 206 and 208 thus maintained in sliding contact with surface 210 of the hasp, the latch member can be lifted upwardly from the frame by means of lug 127 until the top surfaces 144 of link member side walls 66 and 68 are brought into engagement with projections 152 on the latch member. This limits counterclockwise pivotal movement of the latch member relative to the link members and in turn limits clockwise movement of the link members relative to the frame to the position shown in phantom in FIG. 6. As will be apparent hereinafter, the latch member and the link members in this limit position (shown in phantom) have the same relative positions as in the latching condition of the latching device, shown in solid lines in FIG. 6. However, the latch member and the link members are displaced clockwise together about the pivotal axis provided by trunnions 54, 54′, 56, and 56′ beyond the raised positions they assume for latching condition. With the link members so positioned, spring fingers 86 and 86′ of leaf spring G do not make parallel contact with end surfaces 88 of the link member side walls 68. As a result, the leaf spring resiliently opposes movement of the link members into the limit position.

When the manual pressure applied to projection 127 to lift the latch member is released, spring fingers 86 and 86′ cooperate with the end surfaces 88 of the link member side walls to pivot the link members counterclockwise to the raised (solid-line) position shown in FIG. 6, in which the spring fingers make parallel contact with those end surfaces. The leaf spring then opposes pivotal movement of the link members in both directions from the raised position. Projections 140 on the link member side walls cooperate with lugs 132 and 132′ of the latch member to resist pivotal movement of the latch member relative to the link members so that the latch member is pivoted counterclockwise together with the link members. Consequently, as the leaf spring pivots the link members from the limit position to the raised position, the hasp-engaging portion 158 of the latch member is raised sufficiently to completely clear projection 12 of the hasp, as shown in FIG. 6, thereby enabling the luggage case to be opened.

To re-engage the hasp after the luggage case sections are closed, downward manual pressure is applied against the top wall of the latch member to return the latch member to the lowered, latching position shown in FIGS. 4 and 5, the resulting combination of pivotal and translational movements of the latch member acting to draw the hasp toward the frame.

The latch member can be releasably locked in the latching position by inserting key L (FIGS. 2 and 4) into key barrel H and then rotating the key clockwise to bring tooth 194 of the key into engagement with surface 190 on the bolt member in order to move the bolt member from the unlocking position shown in FIG. 2 to the locking position. To unlock the latching device, the key is rotated in the counterclockwise direction to bring the tooth into engagement with surface 192 in order to return the locking bolt to the unlocking position of FIG. 2.

It is believed that the advantages and improved results furnished by the draw bolt of the invention will be apparent from the foregoing description of a preferred embodiment thereof. Various changes and modifications may be made without departing from the spirit and scope of the invention, as sought to be defined in the following claims.

What is claimed is:

1. A draw bolt cooperable with an associated hasp, the draw bolt comprising a frame; link means having one end thereof pivotally connected to the frame; a manually operable latch member pivotally connected to the other end of the link means for movement to latching and unlatching positions, the link means having lowered and raised positions in the latching and unlatching positions, respectively, of the latch member, the latch member and the link means having engageable limiting means for limiting pivotal movement of the link means in a first direction from the lowered position thereof to a third position beyond the raised position; and biasing means for pivoting the link means in the direction opposite to the first direction to reach the raised position thereof, the biasing means resiliently opposing pivotal movement of the link means in both directions from the raised position, the latch member and the link means having cooperable means for resiliently opposing pivotal movement of the latched member relative to the link means.

2. A draw bolt according to claim 1, wherein the biasing means comprises a leaf spring secured to the frame and cooperable with a planar end surface of the link means.

3. A draw bolt according to claim 2, wherein the leaf spring is further cooperable with an additional surface on the link means for resiliently maintaining the link means in the lowered position.

4. A draw bolt according to claim 1, wherein the link means comprises a pair of spaced link members.

5. A draw bolt according to claim 4, wherein the latch member has a top wall with a pair of longitudinally spaced studs depending therefrom, wherein said link member has a longitudinally spaced pair of transverse side walls connected by a top wall, the side walls of the link members being pivotally connected to the studs, wherein the limiting means comprises a pair of longitudinally spaced projections on the top wall of the latch member for engaging a surface on at least one of the side walls of each link member when the link members are in the third position, and wherein the cooperable means comprises a projection on at least one of the side walls of each link member for frictionally engaging a surface on the associated stud of the latch member.

6. A draw bolt according to claim 5, further comprising a bolt member carried by the latch member between the two studs, the bolt member being movable by a key to a locking position in engagement with means provided by the frame for releasably locking the latch member in latching position and being movable to an unlocking position out of engagement with the means provided by the frame.

7. A draw bolt according to claim 1, further comprising key-actuatable locking means for releasably locking the latch member in latching position.

8. A lockable draw bolt cooperable with an associated hasp, the draw bolt comprising a frame having a substantially larger longitudinal axis than the axis transverse thereto; means for connecting the frame to the edge of a luggage case section so that said longitudinal axis is parallel to the parting line of the case; a pair of separate longitudinally spaced link members, each having a pair of transversely spaced walls and having one end pivotally connected to the frame and being movable to raised and lowered positions; a manually operable latch member substantially coextensive with the frame in the lowered position thereof pivotally connected to the other ends of the link members for movement about an axis parallel to said longitudinal axis to latching and unlatching positions; and key-actuatable locking means carried by the latch member between the two link members and engageable with means provided by the frame for releasably locking the latch member in the latching position.

9. A draw bolt according to claim 8, wherein the locking means comprises a bolt member movable by a key to a locking position in engagement with a stud provided by the frame and to an unlocking position out of engagement with the stud.

10. A draw bolt according to claim 8, further comprising a leaf spring having one end mounted on the frame and having another end biased into engagement with planar end surfaces of the link members for resiliently maintaining the link members in the raised position.

11. A draw bolt according to claim 10, wherein the leaf spring is further cooperable with additional surfaces on the link members for resiliently maintaining the link members in lowered position.

* * * * *